US006175975B1

(12) United States Patent
Böttcher et al.

(10) Patent No.: US 6,175,975 B1
(45) Date of Patent: Jan. 23, 2001

(54) FITTING ARRANGEMENT FOR A FOLDING BED

(75) Inventors: Wolfram-Dietrich Böttcher, Mötzingen; Jochen Krauter; Ronald Walther, both of Nagold, all of (DE)

(73) Assignee: Häfele GmbH & Co., Nagold (DE)

( * ) Notice: Under 35 U.S.C. 154(b), the term of this patent shall be extended for 0 days.

(21) Appl. No.: 09/154,907

(22) Filed: Sep. 17, 1998

(30) Foreign Application Priority Data

Sep. 22, 1997 (DE) ..... 297 16 941 U

(51) Int. Cl.[7] ..... A47C 19/12

(52) U.S. Cl. ..... 5/136; 5/133

(58) Field of Search ..... 5/133, 136, 137, 5/138, 159.1, 164.1, 162, 167

(56) References Cited

U.S. PATENT DOCUMENTS 1,358,209 * 11/1920 Hoilo ..... 5/159.1 X
4,901,382 * 2/1990 Spitz ..... 5/136
5,033,134 * 7/1991 Burchett ..... 5/133

* cited by examiner

*Primary Examiner*—Terry Lee Melius
*Assistant Examiner*—Fredrick Conley
(74) *Attorney, Agent, or Firm*—Friedrich Kueffner

(57) ABSTRACT

A fitting arrangement for a folding bed, preferably a wall folding bed, includes a first fitting part on the corpus or body of the bed; a second fitting part on the folding bed, supported pivotally on the first fitting part; and a first holder on the corpus of the bed and a second holder on the folding bed to hold devices, especially spring devices, which exert force on the folding bed to push it into its up position. The first holder is provided on the first fitting part and the second holder is provided on the second fitting part.

6 Claims, 3 Drawing Sheets

FITTING ARRANGEMENT FOR A FOLDING BED

BACKGROUND OF THE INVENTION

1. Field of the Invention

The present invention relates to a fitting arrangement for a folding bed, preferably a wall folding bed, with a first fitting part on the corpus or body of the bed; a second fitting part on the folding bed, supported pivotally on the first fitting part; and with a first holder on the corpus of the bed and a second holder on the folding bed to hold devices, especially spring devices, which exert force on the folding bed to push it into its up position.

2. Description of the Related Art

In beds which can be folded such as wall folding beds or Murphy beds, the folding bed can be pivoted between its folded-up position and its folded-down position within both sides of a bed frame. To make it easier to fold the bed up, a pneumatic spring on each side acts between the bed and the bed corpus; when the bed is folded down, the spring is tensioned, and thus the amount of force required to fold the bed up is reduced.

In known fitting arrangements, fitting parts for supporting the bed and separate holders for the pneumatic springs are provided on the bed corpus and on the bed. Because the pneumatic spring acts not only between the bed and the corpus but also between the fitting parts and the holders on the bed and the corpus, the bed and the corpus, which are usually made of wood, must be made with sufficient mass to absorb the forces of the pneumatic spring. To ensure the optimum function of the pneumatic spring, the holders should be attached only to specific points on the bed and corpus.

SUMMARY OF THE INVENTION

It is therefore the primary object of the present invention to improve the design of the fittings of the general type described above in such a way that the forces exerted on, and to be absorbed by, the corpus and on the bed by the force-exerting device can be reduced.

In accordance with the present invention, the first holder is provided on the first fitting part and the second holder is provided on the second fitting part.

This fitting arrangement forms a complete unit and is characterized by great strength, because the forces of the pneumatic springs are not absorbed via the wood of the bed or bed corpus but rather directly by the two fitting parts. Especially in the case of beds of large dimensions, the weight of the bed and the pneumatic springs are capable of producing powerful forces, but, because of the design of the fittings, these forces can be absorbed optimally between the fitting parts and the hinge points of the spring device. In addition, the lever ratios can be effectively determined by the permanent setting of the distance between the holders and the center of rotation of the bed.

Because the first and second fitting parts can be screwed to the bed corpus and to the folding bed, respectively, installation is simple and easy. The two fitting parts can, for example, be designed as screw-on plates, on which preferably stops are provided to ensure that the plates are installed parallel to the edges of the bed or corpus. In addition, there is also the possibility of supplying the fittings with the force-exerting device of pneumatic springs preinstalled on them.

In a preferred embodiment, a safety device is provided, especially in the case of transversely oriented wall folding beds, to hold the bed securely in its down-folded position against the force of the force-exerting device. Thus, even when a person is lying in the bed behind the center of rotation, the bed is prevented from folding up by itself unintentionally.

In accordance with an advantageous further development of this embodiment, a safety lever is supported pivotally on one of the fitting parts; when the bed is folded down, this lever locks behind a projection on the other fitting part. This safety lever must be freed manually when it is desired to fold the bed up.

In accordance with a preferred embodiment of this further development, it is provided that the support of the safety lever is also installed on one of the fitting parts and/or that the projection is also provided on the other fitting part.

Additional advantages of the invention can be derived from the description and from the drawing. In addition, the features described above and the features according to the invention which are described in more detail below can be used individually on their own or in any desired combination. The embodiments indicated and described are not to be understood as a final list; on the contrary, they have merely the character of examples, which have been selected to facilitate the description of the invention.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 2:
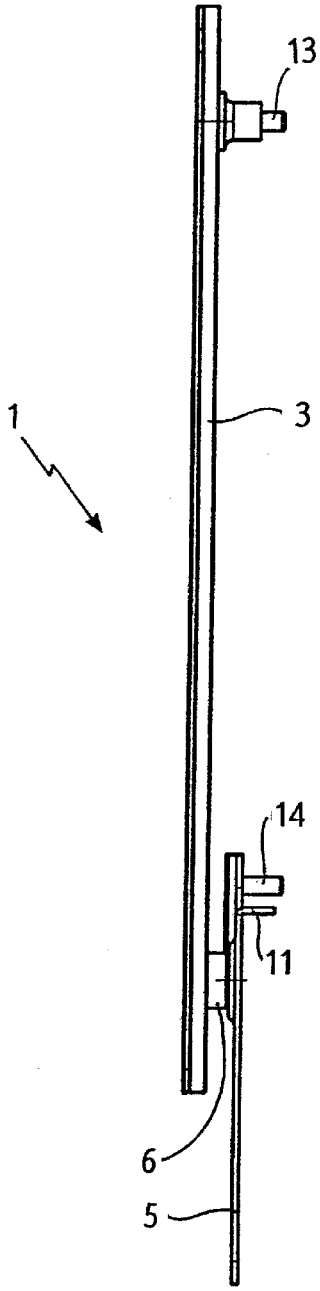
FIG. 2 is a side view of the fitting arrangement according of FIG. 1.
Figure 1:
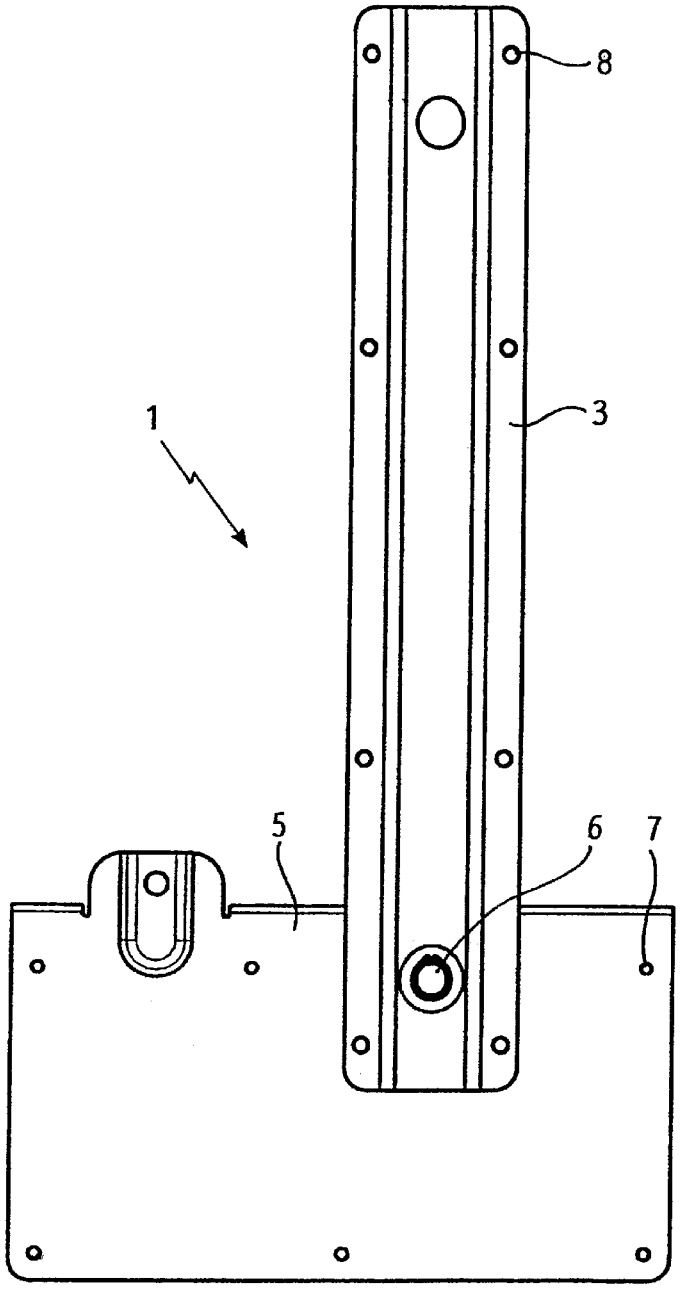
FIG. 1 is a front view of the fitting arrangement according to the present invention for one side of a folding bed.
Figure 3:
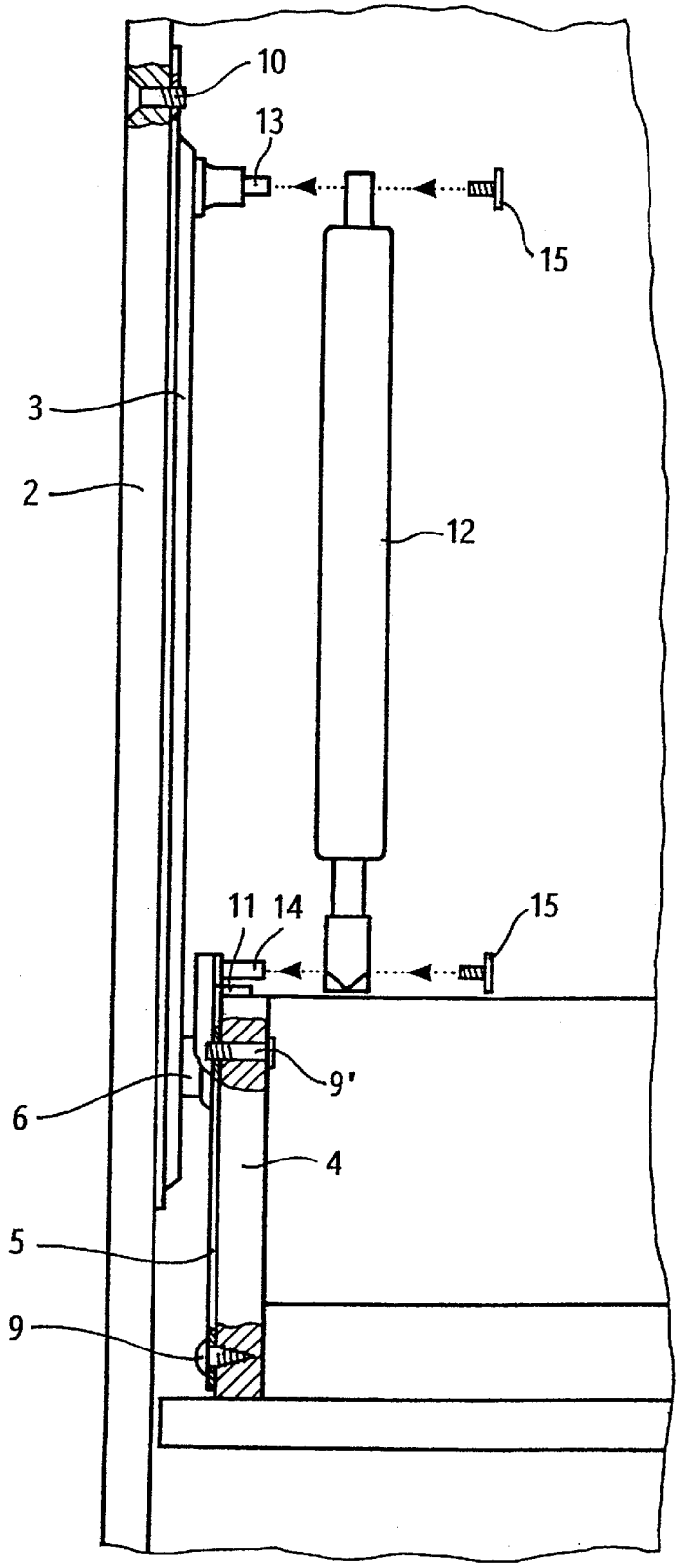
FIG. 3 is a side view of the fitting arrangement provided on the left side of a folding bed with a force-exerting device (pneumatic spring)

The fitting arrangement for a wall folding bed, designated by reference number 1 in the drawing, has a first fitting part 3 to be attached to one side of a corpus 2, shown in FIG. 3, and a second fitting part 5 to be attached to the corresponding side of the folding bed or bed frame 4. A fitting arrangement 1 such as this is provided on each side of the folding bed. The two fitting parts 3, 5 are connected to each other by a bearing 6 around which they can rotate; this bearing simultaneously forms the axis of rotation around which the bed 4 can be folded up and down with respect to the corpus 2. In the illustrated embodiment, the two fitting parts 3, 5 are screw-on plates, which can be attached by a plurality of holes 7, 8 to the corpus and to the side of the bed by means of screw fasteners 9, 9', 10, wherein the position on the bed 4 is determined by a guide edge 11 on the second fitting part 5. In FIGS. 1 and 2, fitting arrangement 1 is shown in the position it occupies when the bed 4 is folded down.

To make it easier for the bed 4 to be folded up, a force-exerting device 12, especially a compression spring, i.e., pneumatic spring, acts between the corpus 2 and the bed 4. When the bed is folded down, the device is put under tension, and thus the amount of force required to fold the bed 4 up later is reduced. For this purpose, a holder 13, 14, in the form of studs, is provided on each fitting part 3, 5; one end of the force-exerting device 12 is attached to the end of each of these studs. In the illustrated embodiment, a pneumatic spring is fitted onto the stud and held in place by a screw 15, as shown in FIG. 3. The forces acting as a result of the force-exerting device 12 are not transmitted to the wood of the bed 4 or the corpus 2 but rather are absorbed directly by the two fitting parts 3, 5.

Figure 4:
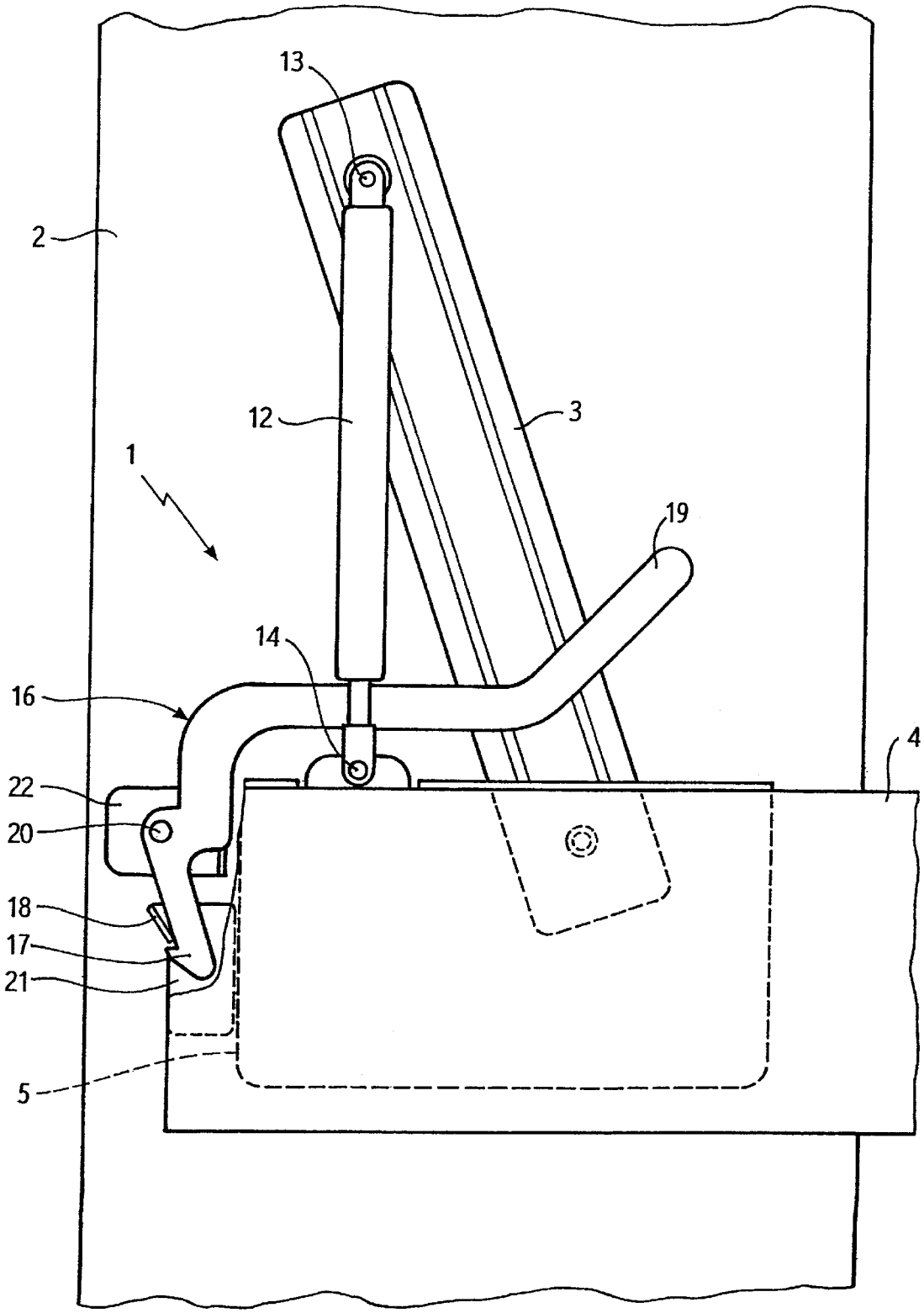
FIG. 4 is a rear view of the fitting arrangement of FIG. 1 with a safety device to hold the folded-down bed in position.

To prevent the bed 4 from folding up unintentionally by itself, a locking lever 16 is mounted as a safety device on the bed 4 in such a way that it is free to pivot, as shown in FIG. 4. One of its ends 17 is hook-shaped so that it can lock behind a projection 18 on the corpus 2 after the bed 4 has been folded down and thus can hold the bed 4 in its folded-down position against the force of the device 12. To fold the bed 4 up, this safety lever 16 must then be freed manually by manipulating its other end 19. In the illustrated embodiment, the projection 18 and the bearing 20 of the safety lever 16 are each provided on separate fitting parts 21, 22 on the bed 4 and the corpus 2, respectively. If necessary, these fitting parts 21, 22 can also be provided on the first or second fitting part 3, 5.

While specific embodiments of the invention have been shown and described in detail to illustrate the inventive principles, it will be understood that the invention may be embodied otherwise without departing from such principles.

We claim:

1. A fitting arrangement for a folding bed, especially a wall folding bed, the arrangement comprising:

a first fitting part for mounting on a bed corpus and a second fitting part for mounting on the folding bed;

a bearing directly connected to the first and second fitting parts so that the second fitting part is pivotally supported via the bearing on the first fitting part;

the first fitting part having a first holder and the second fitting part having a second holder;

a force-exerting device attached to the first and second holders for exerting a force on the second fitting part such that the second fitting part pivots about the bearing relative to the first fitting part for pushing the folding bed into an upwardly folded position relative to the bed corpus.

2. The fitting arrangement according to claim 1, wherein the force-exerting device is a spring.

3. The fitting arrangement according to claim 1, comprising means for screwing the first fitting part to the bed corpus and for screwing the second fitting part to the folding bed.

4. The fitting arrangement according to claim 1, further comprising a safety device for holding the folding bed against the force of the force-exerting device in a folded-down position.

5. The fitting arrangement according to claim 4, wherein the safety device is comprised of a safety lever pivotally mounted on one of the fitting parts, and wherein the safety lever is configured to engage a projection mounted on another of the fitting parts when the bed is in the folded-down position.

6. The fitting arrangement according to claim 5, further comprising a bearing for the safety lever, wherein the bearing is mounted on the first fitting part and the projection is mounted on the second fitting part.

* * * * *